US009142345B2

(12) United States Patent
Chen et al.

(10) Patent No.: US 9,142,345 B2
(45) Date of Patent: Sep. 22, 2015

(54) BENT CONDUCTION SHEET MEMBER, COVERING MEMBER AND CONDUCTIVE WINDING ASSEMBLY COMBINING SAME

(71) Applicant: DELTA ELECTRONICS, INC., Taoyuan Hsien (TW)

(72) Inventors: Chia-Hung Chen, Taoyuan Hsien (TW); Kun-Te Chen, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 0 days.

(21) Appl. No.: 14/206,996

(22) Filed: Mar. 12, 2014

(65) Prior Publication Data

US 2015/0206647 A1 Jul. 23, 2015

(30) Foreign Application Priority Data

Jan. 17, 2014 (CN) ..... 2014 1 0022365

(51) Int. Cl.
*H01F 27/28* (2006.01)
*H01F 27/30* (2006.01)

(52) U.S. Cl.
CPC .... *H01F 27/2847* (2013.01); *H01F 2027/2861* (2013.01)

(58) Field of Classification Search
CPC ... H01F 27/28; H01F 27/2847; H01F 27/306; H01F 27/30; H01F 27/32; H01F 27/323; H01F 27/324; H01F 27/325; H01F 5/06; H01F 2027/2861
USPC ..... 336/223, 207, 196, 199, 198, 208
See application file for complete search history.

(56) References Cited

U.S. PATENT DOCUMENTS 2,497,516 A * 2/1950 Phelps ..... 336/62
2,902,661 A * 9/1959 Le Roy Henderson ..... 336/196

* cited by examiner

*Primary Examiner* — Mangtin Lian
(74) *Attorney, Agent, or Firm* — Kirton McConkie; Evan R. Witt

(57) ABSTRACT

A conductive winding assembly combining a bent conduction sheet member and a covering member is provided. The bent conduction sheet member has a channel. The covering member includes a connection part, a first lateral plate, a second lateral plate, and a hollow part. A first groove is arranged between the first lateral plate and the connection part. A second groove is arranged between the second lateral plate and the connection part. The bent conduction sheet member is inserted into the covering member through the first groove and the second groove, and the connection part is inserted into the channel. The bent conduction sheet member is partially accommodated within the hollow part, and the bent conduction sheet member is partially exposed outside the covering member through the hollow part.

19 Claims, 8 Drawing Sheets

BENT CONDUCTION SHEET MEMBER, COVERING MEMBER AND CONDUCTIVE WINDING ASSEMBLY COMBINING SAME

TECHNICAL FIELD

The present disclosure relates to a conductive winding assembly, and more particularly to a bent conduction sheet member, a covering member and a conductive winding assembly combining the covering member and the bent conduction sheet member for a magnetic device.

BACKGROUND OF THE DISCLOSURE

A transformer is a magnetic device that transfers electric energy from one circuit to another circuit through coils in order to regulate the voltage to a desired range for powering an electronic device. Moreover, the use of the transformer may increase or decrease the voltage of the AC power, change impedance, stabilize voltages and isolate circuits.

Conventionally, the transformer includes at least one winding coil assembly, a magnetic core assembly and a bobbin. Moreover, the transformer may further comprise a covering member for sheltering the winding coil assembly in order to increase the creepage distance of the winding coil assembly and the insulating efficacy of the transformer.

Nowadays, the transformer in the industrial power supply apparatus is designed for withstanding large current. As known, the winding coil assembly of the conventional transformer is usually composed of enameled wires, and the conventional transformer has no heat-dissipating mechanism. After the transformer has been used for a certain time period, heat is readily accumulated within the transformer and winding loss of the winding coil assembly is increased. Under this circumstance, the temperature of the overall transformer is increased, and the performance of the transformer is deteriorated.

For solving the above drawbacks, some transformers use copper sheets as the winding coil assemblies in replace of enameled wires. Consequently, the winding loss and the temperature are effectively reduced. That is, the transformer includes copper sheets, a magnetic core assembly and a bobbin. However, due to the assembling tolerance, the copper sheets are readily rocked and aren't easy to be positioned. Moreover, since the winding coil assembly is encapsulated by the covering member, the heat-dissipating efficacy is also unsatisfied.

Therefore, there is a need of providing a bent conduction sheet member, a covering member and a conductive winding assembly combining the covering member and the bent conduction sheet member in order to eliminate the above drawbacks.

SUMMARY OF THE DISCLOSURE

The present disclosure provides a bent conduction sheet member, a covering member and a conductive winding assembly combining the covering member and the bent conduction sheet member. The covering member has a hollow part for accommodating the bent conduction sheet member, so that the bent conduction sheet member is partially exposed outside the covering member through the hollow part. Consequently, the heat generated by the bent conduction sheet member may be dissipated away through the hollow part in convection, and the heat-dissipating efficacy of the conductive winding assembly is largely enhanced. Moreover, the covering member has a plurality of bulges and a coupling plate for facilitating fixing the bent conduction sheet member, the bent conduction sheet member is not rocked relative to the covering member and easy to be positioned.

An aspect of the present disclosure provides a conductive winding assembly for a magnetic device. The conductive winding assembly includes a bent conduction sheet member and a covering member. The bent conduction sheet member has a channel. The covering member is used for partially covering the bent conduction sheet member. The covering member includes a connection part corresponding to the channel, a first lateral plate, a second lateral plate, and a hollow part. The first lateral plate is located at a first side of the connection part. A first groove is arranged between the first lateral plate and the connection part. The second lateral plate is located at a second side of the connection part, and opposed to the first lateral plate. A second groove is arranged between the second lateral plate and the connection part. The bent conduction sheet member is inserted into the covering member through the first groove and the second groove, and the connection part is inserted into the channel. The hollow part is defined by the first lateral plate, the second lateral plate and a top surface of the connection part and located at a top side of the covering member. The bent conduction sheet member is partially accommodated within the hollow part, and the bent conduction sheet member is partially exposed outside the covering member through the hollow part.

Another aspect of the present disclosure provides a bent conduction sheet member for a magnetic device. The bent conduction sheet member is connectable with a covering member of the magnetic device, and the covering member is used for partially covering an outer periphery of the bent conduction sheet member. The bent conduction sheet member includes a first bent conduction sheet and a second bent conduction sheet. The first bent conduction sheet includes a first main body and a first through hole. The first through hole passes through the first main body. The second bent conduction sheet includes a second main body and a second through hole. The second through hole passes through the second main body. After the first main body is accommodated within the second through hole, the first bent conduction sheet and the second bent conduction sheet are combined together, and the first through hole and the second through hole are collaboratively defined as a channel.

A further aspect of the present disclosure provides a covering member for a magnetic device. The covering member is connectable with a bent conduction sheet member of the magnetic device, and the covering member is used for partially covering an outer periphery of the bent conduction sheet member. The covering member includes a connection part, a first lateral plate, a second lateral plate, and a hollow part. The first lateral plate is located at a first side of the connection part. A first groove is arranged between the first lateral plate and the connection part. The second lateral plate is located at a second side of the connection part, and opposed to the first lateral plate. A second groove is arranged between the second lateral plate and the connection part, wherein the bent conduction sheet member is inserted into the covering member through the first groove and the second groove. The hollow part is defined by the first lateral plate, the second lateral plate and a top surface of the connection part and located at a top side of the covering member. The bent conduction sheet member is partially accommodated within the hollow part, and the bent conduction sheet member is partially exposed outside the covering member through the hollow part.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
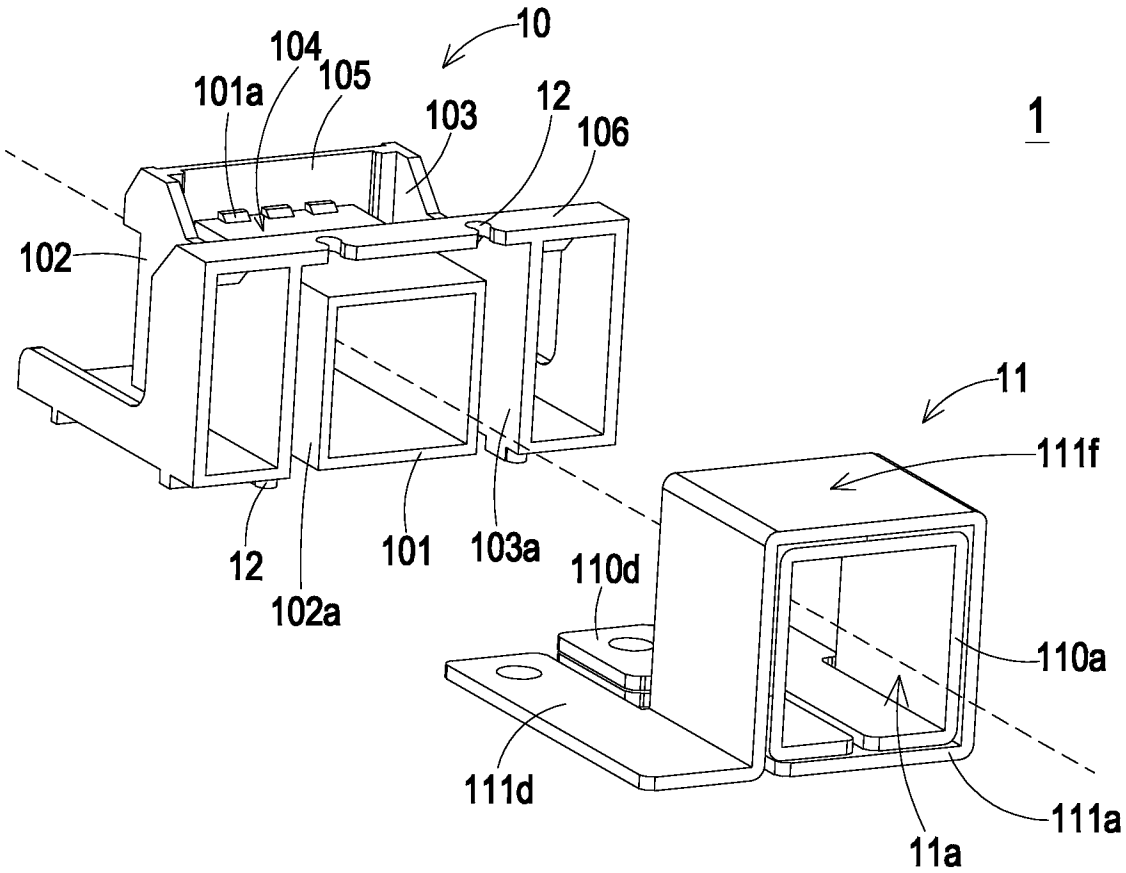
FIG. 1 is a schematic exploded view illustrating a conductive winding assembly according to an embodiment of the present disclosure.

FIG. 1 is a schematic exploded view illustrating a conductive winding assembly combining a covering member and a bent conduction sheet member according to an embodiment of the present disclosure. The conductive winding assembly 1 is applied to a magnetic device. The magnetic device is for example a transformer, but is not limited thereto. As shown in FIG. 1, the conductive winding assembly 1 includes a covering member 10 and a bent conduction sheet member 11.

Figure 2:
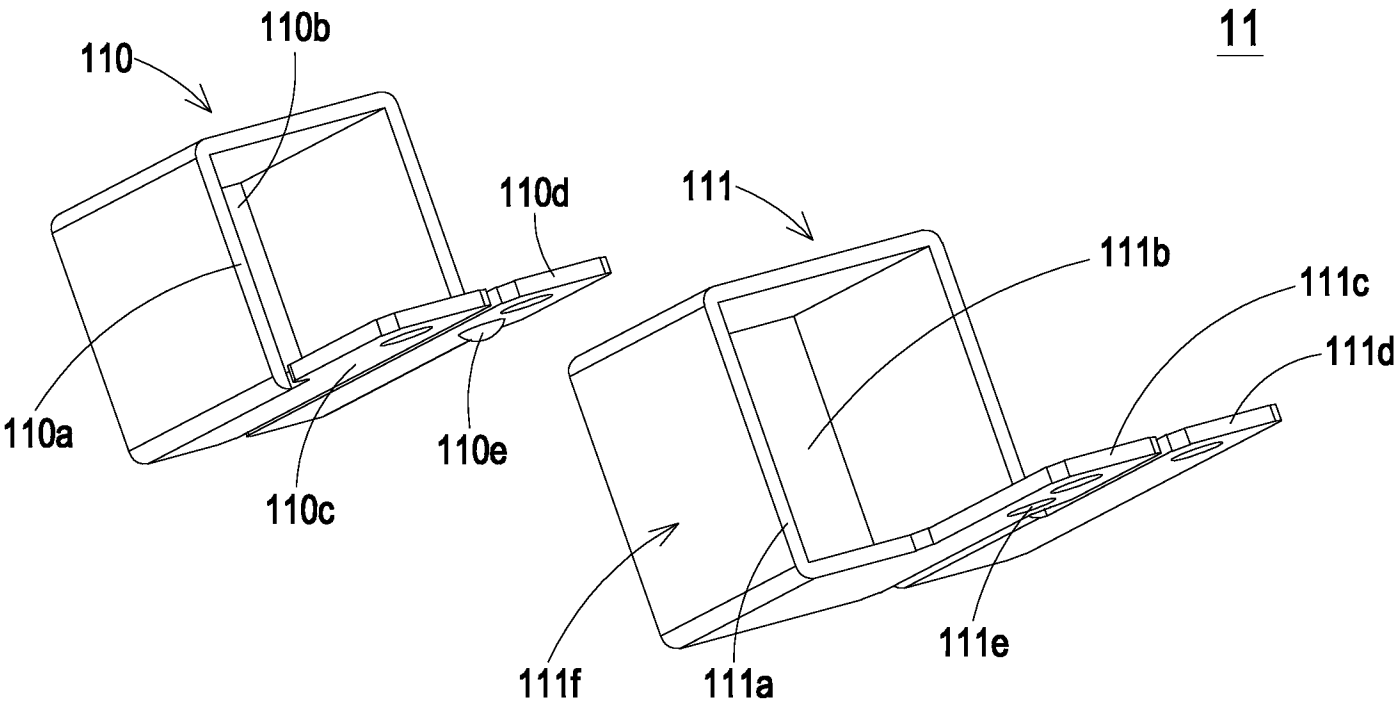
FIG. 2 is a schematic exploded view illustrating the bent conduction sheet member of the conductive winding assembly of FIG. 1.

FIG. 2 is a schematic exploded view illustrating the bent conduction sheet member of the conductive winding assembly of FIG. 1. As shown in FIGS. 1 and 2, the bent conduction sheet member 11 includes a first bent conduction sheet 110 and a second bent conduction sheet 111. The first bent conduction sheet 110 and the second bent conduction sheet 111 may be combined with each other. Each of the first bent conduction sheet 110 and the second bent conduction sheet 111 is produced by bending a metal sheet (e.g. a copper sheet). The first bent conduction sheet 110 includes a first main body 110*a* and a first through hole 110*b*. That is, the first main body 110*a* is substantially a hollow box produced by bending the metal sheet, and the first through hole 110*b* is formed in the first main body 110*a*. The second bent conduction sheet 111 includes a second main body 111*a* and a second through hole 111*b*. The second main body 111*a* includes an outer periphery 11*f*. That is, the second main body 111*a* is also a hollow box produced by bending the metal sheet, and the second through hole 111*b* is formed in the second main body 111*a*. Moreover, the size and shape of the second through hole 111*b* of the second bent conduction sheet 111 match the size and shape of the first main body 110*a* of the first bent conduction sheet 110. After the first main body 110*a* of the first bent conduction sheet 110 is accommodated within the second through hole 111*b* of the second bent conduction sheet 111, the first bent conduction sheet 110 and the second bent conduction sheet 111 are combined together. Under this circumstance, the first through hole 110*b* and the second through hole 111*b* are collaboratively defined as a channel 11*a* (see FIG. 1), wherein the channel 11*a* is formed by four sides, and the four sides surround the channel 11*a*. The outer periphery 111*f* of the second bent conduction sheet 111 can be viewed as an outer periphery 111*f* of the bent conduction sheet member 11.

Figure 3:
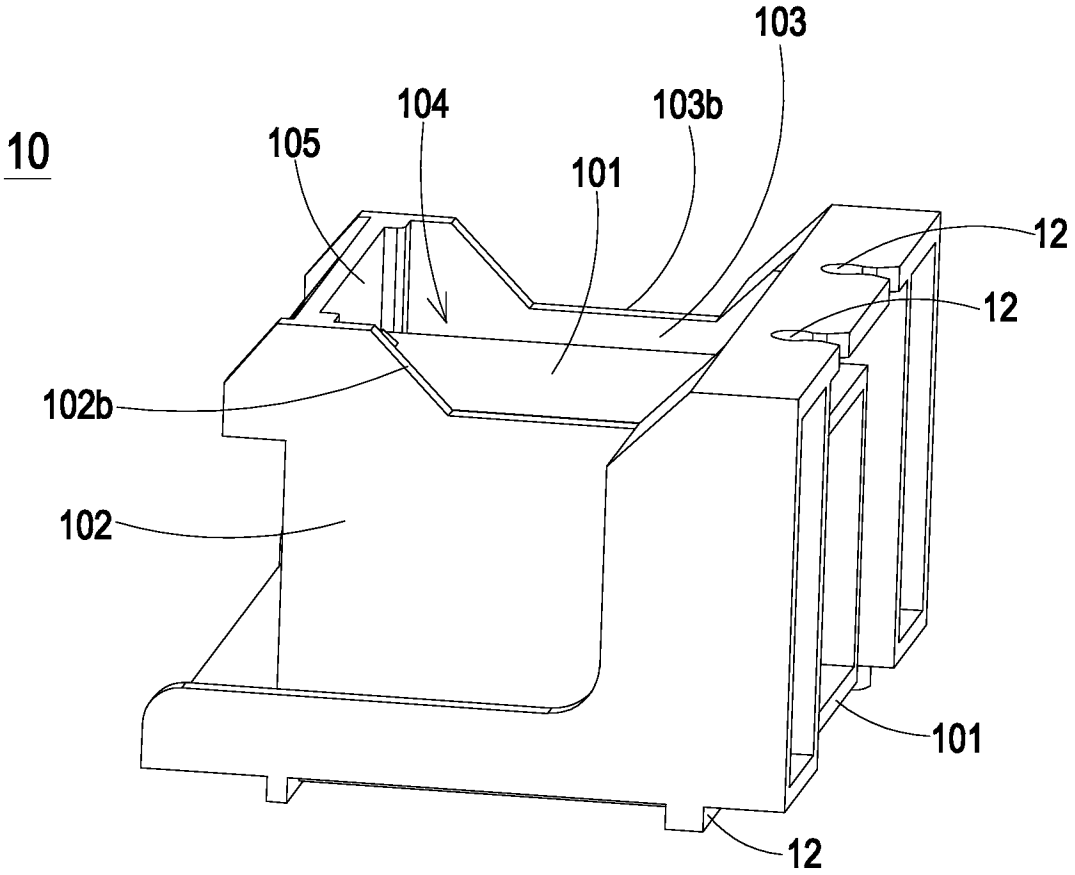
FIG. 3 is a schematic perspective view illustrating the covering member of the conductive winding assembly of FIG. 1 and taken along another viewpoint.
Figure 4:
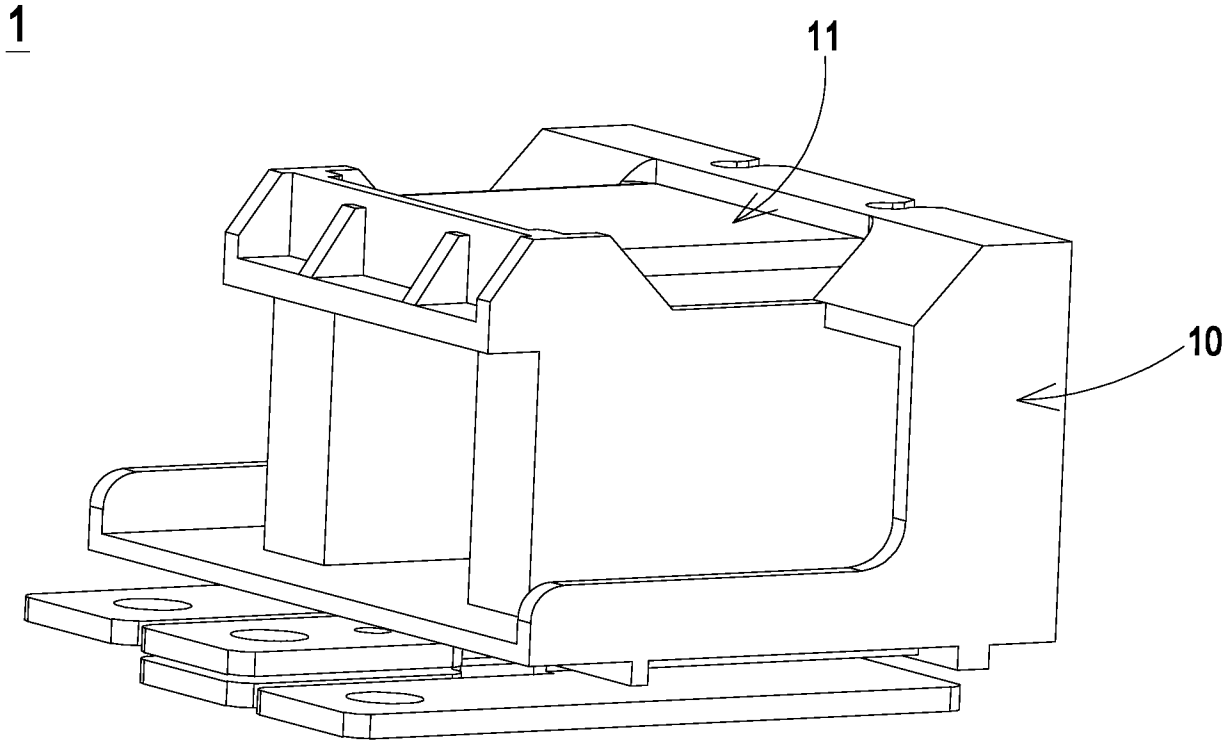
FIG. 4 is a schematic perspective view illustrating the conductive winding assembly of FIG. 1 and taken along another viewpoint.

FIG. 3 is a schematic perspective view illustrating the covering member of the conductive winding assembly of FIG. 1 and taken along another viewpoint. FIG. 4 is a schematic perspective view illustrating the conductive winding assembly of FIG. 1 and taken along another viewpoint. Please refer to FIGS. 1~4. The covering member 10 is made of an insulating material. The covering member 10 is used for partially covering the outer periphery 111*f* of the bent conduction sheet member 11 in order to increase the creepage distance of the bent conduction sheet member 11 and increase the insulating efficacy of the conductive winding assembly 1. The covering member 10 includes a connection part 101, a first lateral plate 102, a second lateral plate 103, and a hollow part 104. In this embodiment, the connection part 101 is a hollow structure, but is not limited thereto. The size and shape of the connection part 101 of the covering member 10 match the size and shape of the channel 11*a* of the bent conduction sheet member 11. Consequently, after the connection part 101 of the covering member 10 is inserted into the channel 11*a* of the bent conduction sheet member 11, the bent conduction sheet member 11 is disposed on the connection part 101. The first lateral plate 102 is located at a first side of the connection part 101. Moreover, a first groove 102*a* is arranged between the first lateral plate 102 and the connection part 101. The second lateral plate 103 is opposed to the first lateral plate 102, and located at a second side of the connection part 101. Moreover, a second groove 103*a* is arranged between the second lateral plate 103 and the connection part 101. After the connection part 101 of the covering member 10 is inserted into the channel 11*a* of the bent conduction sheet member 11, the bilateral sides of the bent conduction sheet member 11 are partially accommodated within the first groove 102*a* and the second groove 103*a* of the covering member 10. The hollow part 104 is defined by the first lateral plate 102, the second lateral plate 103 and a top surface of the connection part 101, and the hollow part 104 is located at a top side of the covering member 10 and between the first lateral plate 102 and the second lateral plate 103. The size and shape of the hollow part 104 of the covering member 10 match the size and shape of the top portion of the second main body 111*a* of the second bent conduction sheet 111 of the bent conduction sheet member 11. The hollow part 104 of the covering member 10 is used for accommodating portion of the bent conduction sheet member 11. Namely, after the connection part 101 of the covering member 10 is inserted into the channel 11*a* of the bent conduction sheet member 11, the top side of the bent conduction sheet member 11 is partially exposed to the hollow part 104. In some embodiments, after the bilateral sides of the bent conduction sheet member 11 are partially accommodated within the first groove 102*a* and the second groove 103*a* of the covering member 10, the bent conduction sheet member 11 can be moved at the top side of the covering member 10. Namely, the bent conduction sheet member 11 can be pushed upwardly toward the hollow part 104. Consequently, the bent conduction sheet member 11 is partially accommodated within the hollow part 104, and the bent conduction sheet member 11 is in contact with the first lateral plate 102 and the second lateral plate 103. Under this circumstance, the bent conduction sheet member 11 is securely fixed in the hollow part 104 of the covering member 10 (see FIG. 4).

From the above discussions, the bent conduction sheet member 11 may be exposed outside the covering member 10 through the hollow part 104 when the covering member 10 and the bent conduction sheet member 11 are combined together. Consequently, when the conductive winding assembly 1 which combines the covering member 10 and the bent conduction sheet member 11 is applied to a magnetic device, the heat generated by the bent conduction sheet member 11 may be dissipated away through the hollow part 104 in convection. As previously described, the winding coil assembly of the conventional transformer is encapsulated by the conventional covering member. In comparison with the conventional transformer, the heat-dissipating efficacy of the conductive winding assembly 1 of the transformer of the present disclosure is largely enhanced.

In an embodiment, after the bent conduction sheet member 11 is partially accommodated within the hollow part 104, the top side of the bent conduction sheet member 11 and the top portions of the first lateral plate 102 and the second lateral plate 103 are on a common plane of the covering member 10 (i.e. located at the top side of the covering member 10). Moreover, the first lateral plate 102 further includes a first heat-dissipating recess 102*b*, and the second lateral plate 103 further includes a second heat-dissipating recess 103*b*. The first heat-dissipating recess 102*b* is concaved in the top surface of the first lateral plate 102. The second heat-dissipating recess 103*b* is concaved in the top surface of the second lateral plate 103. When the bent conduction sheet member 11 is partially accommodated within and fixed in the hollow part 104 of the covering member 10, the bilateral sides of the bent conduction sheet member 11 are partially exposed outside the covering member 10 through the first heat-dissipating recess 102*b* and the second heat-dissipating recess 103*b*. Consequently, the heat generated by the bent conduction sheet member 11 may be dissipated away through the first heat-dissipating recess 102*b* and the second heat-dissipating recess 103*b* in convection. Under this circumstance, the heat-dissipating efficacy of the conductive winding assembly 1 is further increased.

In some embodiments, as shown in FIG. 1, the covering member 10 further includes a position-limiting plate 105. The position-limiting plate 105 is arranged between the first lateral plate 102 and the second lateral plate 103. The position-limiting plate 105 is connected with a first end of the first lateral plate 102, a first end of the second lateral plate 103 and a first end of the connection part 101. After the connection part 101 of the covering member 10 is inserted into the channel 11*a* of the bent conduction sheet member 11, and after the bilateral sides of the bent conduction sheet member 11 are accommodated within the covering member 10 through the first groove 102*a* and the second groove 103*a*, the conduction sheet member 11 is stopped by the position-limiting plate 105. Consequently, the position of the conduction sheet member 11 is limited by the position-limiting plate 105.

Please refer to FIGS. 1 and 2 again. In some embodiments, the first bent conduction sheet 110 further includes a first extension part 110*c* and a second extension part 110*d*. The first extension part 110*c* and the second extension part 110*d* are extended outwardly from two edges of the first main body 110*a* and in parallel with each other. The first extension part 110*c* and the second extension part 110*d* may be connected with or inserted into an electronic component (not shown) and/or a circuit board (not shown) in order to receive or output electric power. The second bent conduction sheet 111 further includes a third extension part 111*c* and a fourth extension part 111*d*. The third extension part 111*c* and the fourth extension part 111*d* are extended outwardly from two edges of the second main body 111*a* and in parallel with each other. The third extension part 111*c* of the second bent conduction sheet 111 is aligned with the second extension part 110*d* of the first bent conduction sheet 110. When the first bent conduction sheet 110 and the second bent conduction sheet 111 are combined together, the second extension part 110*d* is stacked on the third extension part 111*c*. The third extension part 111*c* and the fourth extension part 111*d* may be connected with or inserted into an electronic component (not shown) and/or a circuit board (not shown) in order to receive or output electric power.

In some embodiments, the first bent conduction sheet 110 further includes a first engaging part 110*e*, and the second bent conduction sheet 111 further includes a second engaging part 111*e*. The first engaging part 110*e* is disposed on the second extension part 110*d*. The second engaging part 111*e* is disposed on the third extension part 111*c*. When the first bent conduction sheet 110 and the second bent conduction sheet 111 are combined together and the second extension part 110*d* is stacked on the third extension part 111*c*, the first engaging part 110*e* and the second engaging part 111*e* are engaged with each other. Due to the engagement between the first engaging part 110*e* and the second engaging part 111*e*, the first bent conduction sheet 110 and the second bent conduction sheet 111 are securely connected with each other. In this embodiment, the first engaging part 110*e* is a salient, and the second engaging part 111*e* is a hole. It is noted that numerous modifications and alterations may be made while retaining the teachings of the disclosure. For example, in some other embodiments, the first engaging part 110*e* is a hole, and the second engaging part 111*e* is a salient.

Figure 5:
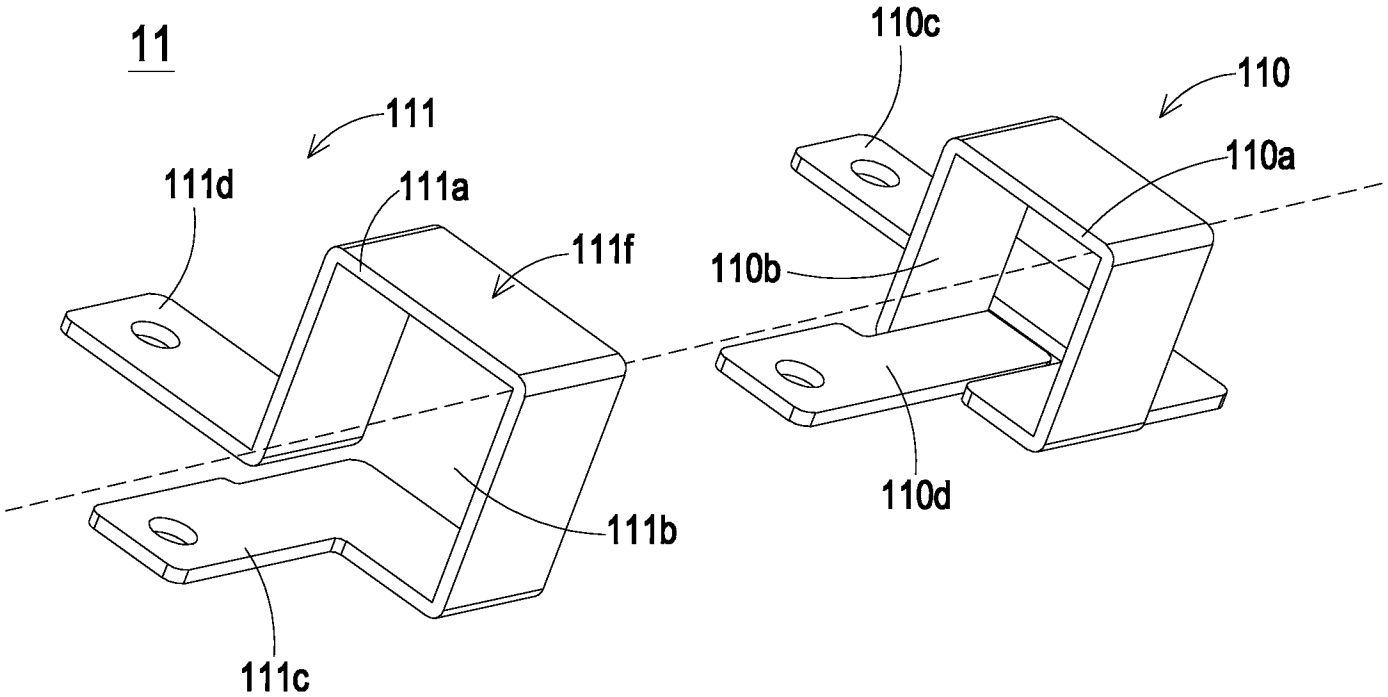
FIG. 5 is a schematic exploded view illustrating a variant of the bent conduction sheet member of the conductive winding assembly of FIG. 1.
Figure 6:
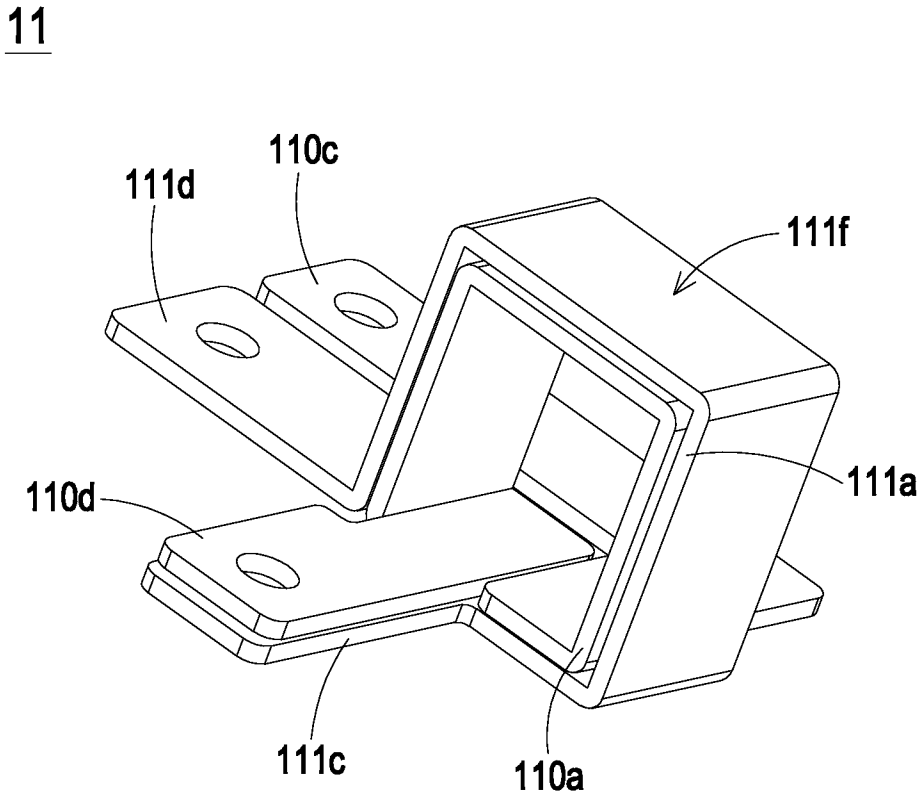
FIG. 6 is a schematic perspective view illustrating the bent conduction sheet member of FIG. 5.

It is noted that the first bent conduction sheet 110 and the second bent conduction sheet 111 may be modified. Namely, the first extension part 110*c* and the second extension part 110*d* of the first bent conduction sheet 110 aren't limited to be extended outwardly from two edges of the first main body 110*a* and in parallel with each other. The third extension part 111*c* and the fourth extension part 111*d* of the second bent conduction sheet 111 aren't limited to be extended outwardly from two edges of the second main body 111*a* and in parallel with each other. FIG. 5 is a schematic exploded view illustrating a variant of the bent conduction sheet member of the conductive winding assembly of FIG. 1. FIG. 6 is a schematic perspective view illustrating the bent conduction sheet member of FIG. 5. As shown in FIGS. 5 and 6, in this embodiment, the first extension part 110*c* of the first bent conduction sheet 110 is extended outwardly from an edge of the first main body 110*a*, and the first extension part 110*c* and the second extension part 110*d* are perpendicular to each other. The third extension part 111*c* of the second bent conduction sheet 111 is extended outwardly from an edge of the second main body 111*a*, and the third extension part 111*c* and the fourth extension part 111*d* are perpendicular to each other.

Please refer to FIG. 1 again. For allowing the bent conduction sheet member 11 in contact with the first lateral plate 102 and the second lateral plate 103 and facilitating fixing the bent conduction sheet member 11 in the hollow part 104 of the covering member 10 when the outer periphery 111*f* of the bent conduction sheet member 11 is partially covered by the covering member 10, the covering member 10 further includes a plurality of bulges 101*a* and a coupling plate 106. The bulges 101*a* are disposed on a top surface of the connection part 101 and arranged beside the position-limiting plate 105. When the connection part 101 of the covering member 10 is inserted into the channel 11*a* of the bent conduction sheet member 11 and the bilateral sides of the bent conduction sheet member 11 are accommodated within the covering member 10 through first groove 102*a* and the second groove 103*a*, the bulges 101*a* are sustained against an inner wall of the first bent conduction sheet 110 of the bent conduction sheet member 11 (i.e. the inner wall of channel 11*a*). Under this circumstance, the bent conduction sheet member 11 is slightly inclined inserted into the covering member 10 by the bulges 101*a*. Since the bent conduction sheet member 11 is aslant moved toward the top side of the covering member 10 (i.e. the bent conduction sheet member 11 is aslant moved toward the hollow part 104 of the covering member 10), the bent conduction sheet member 11 can be accommodated within the hollow part 104 more easily when compared with the horizontal movement of the bent conduction sheet member 11. As shown in FIG. 1, the covering member 10 includes three bulges 101*a*. The number of the bulges 101*a* may be varied according to the practical requirements as long as the bulges 101*a* can be uniformly sustained against the inner wall of the first bent conduction sheet 110 of the bent conduction sheet member 11 (i.e. the inner wall of channel 11*a*).

The coupling plate 106 is located at a top side of the covering member 10, arranged between the first lateral plate 102 and the second lateral plate 103, and opposed to the position-limiting plate 105. Moreover, the coupling plate 106 is connected with a second end of the first lateral plate 102 and a second end of the second lateral plate 103. When the bulges 101*a* are sustained against the inner wall of the first bent conduction sheet 110 of the bent conduction sheet member 11 (i.e. the inner wall of channel 11*a*) and the bent conduction sheet member 11 can be accommodated within the hollow part 104, the coupling plate 106 is in contact with the bent conduction sheet member 11. Since the bent conduction sheet member 11 is fixed in the covering member 10 through the first lateral plate 102, the second lateral plate 103, the position-limiting plate 105 and the coupling plate 106, the bent conduction sheet member 11 is not rocked relative to the covering member 10.

Figure 7:
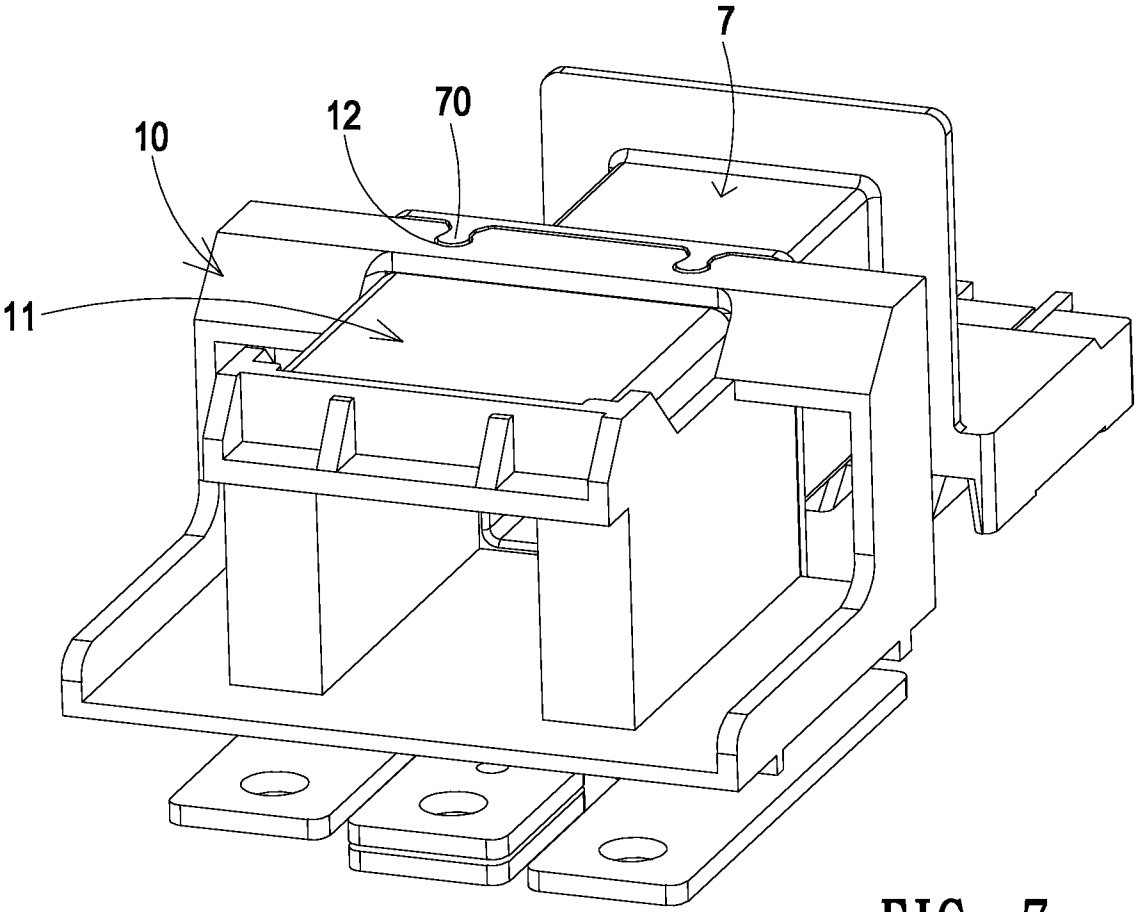
FIG. 7 is a schematic perspective view illustrating the combination of the conductive winding assembly of FIG. 1 and a bobbin according to an embodiment of the present disclosure.
Figure 8:
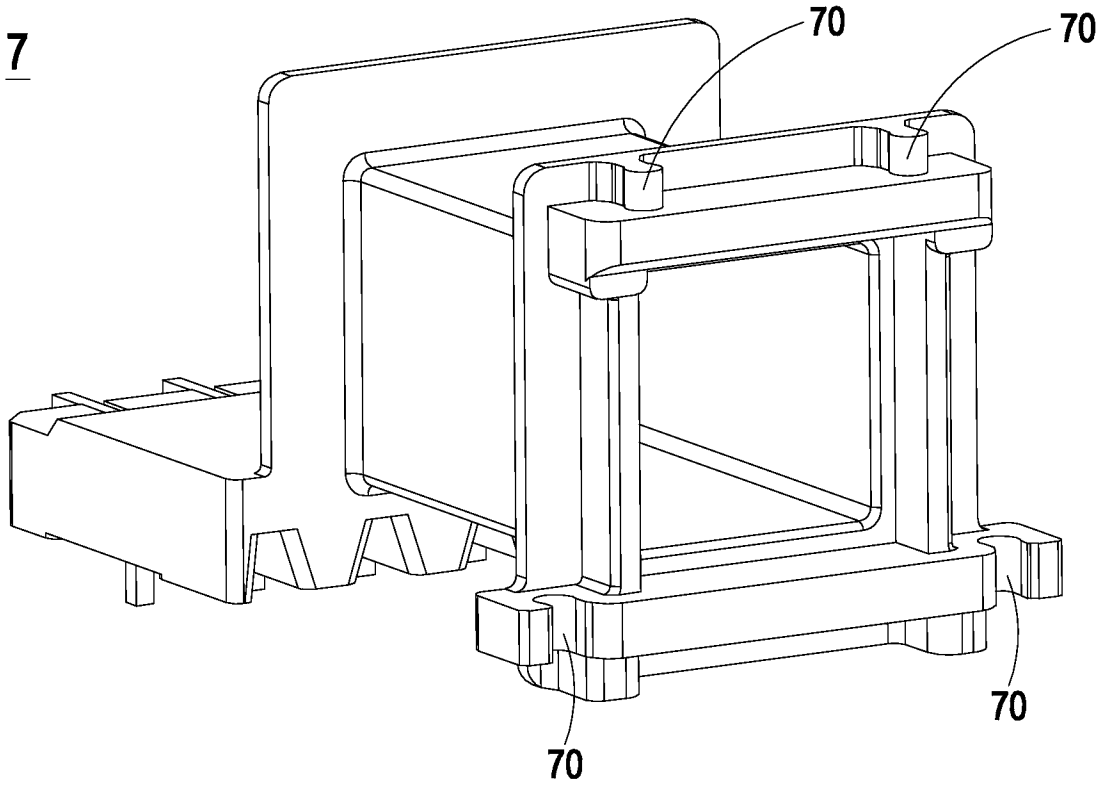
FIG. 8 is a schematic perspective view illustrating the bobbin of FIG. 7 and taken along another viewpoint.

FIG. 7 is a schematic perspective view illustrating the combination of the conductive winding assembly of FIG. 1 and a bobbin according to an embodiment of the present disclosure. FIG. 8 is a schematic perspective view illustrating the bobbin of FIG. 7 and taken along another viewpoint. The conductive winding assembly 1 may be combined with a bobbin 7. For combining the conductive winding assembly 1 with the bobbin 7, the bobbin 7 includes a plurality of fourth engaging parts 70, and the conductive winding assembly 1 includes a plurality of third engaging parts 12 corresponding to the fourth engaging parts 70. In this embodiment, the third engaging parts 12 are formed on the coupling plate 106. Preferably, the fourth engaging parts 70 are convex structures, and the third engaging parts 12 are concave structures. Alternatively, the fourth engaging parts 70 are concave structures, and the third engaging parts 12 are convex structures. Due to the engagement between the third engaging parts 12 and the fourth engaging parts 70, the conductive winding assembly 1 and the bobbin 7 are combined together.

From the above descriptions, the present disclosure provides a bent conduction sheet member, a covering member and a conductive winding assembly combining the covering member and the bent conduction sheet member. The covering member has a hollow part for accommodating the bent conduction sheet member, so that the bent conduction sheet member is partially exposed outside the covering member through the hollow part. Consequently, the heat generated by the bent conduction sheet member may be dissipated away through the hollow part in convection, and the heat-dissipating efficacy of the conductive winding assembly is largely enhanced. Moreover, when a connection part of the covering member is inserted into a channel of the bent conduction sheet member and the bilateral sides of the bent conduction sheet member are accommodated within a first groove and a second groove, the bulges of the covering member are sustained against the inner wall of channel. Consequently, the bent conduction sheet member is aslant moved toward the hollow part of the covering member. Moreover, since a coupling plate of covering member is in contact with the bent conduction sheet member, the bent conduction sheet member 11 is not rocked relative to the covering member.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A conductive winding assembly for a magnetic device, the conductive winding assembly comprising:

a bent conduction sheet member having a channel, wherein the channel is formed by four sides, and the four sides surround the channel; and a covering member for partially covering the bent conduction sheet member, wherein the covering member comprises:

a connection part;

a first lateral plate located at a first side of the connection part, wherein a first groove is arranged between the first lateral plate and the connection part;

a second lateral plate located at a second side of the connection part and opposed to the first lateral plate, wherein a second groove is arranged between the second lateral plate and the connection part, wherein the bent conduction sheet member is inserted into the covering member through the first groove and the second groove, and the connection part is inserted into the channel; and a hollow part defined by the first lateral plate, the second lateral plate and a top surface of the connection part and located at a top side of the covering member, wherein the bent conduction sheet member is partially accommodated within the hollow part, and the bent conduction sheet member is partially exposed outside the covering member through the hollow part.

2. The conductive winding assembly according to claim 1, wherein the bent conduction sheet member comprises a first bent conduction sheet and a second bent conduction sheet, the first bent conduction sheet and the second bent conduction sheet are combined with each other.

3. The conductive winding assembly according to claim 2, wherein each of the first bent conduction sheet and the second bent conduction sheet is produced by bending a metal sheet.

4. The conductive winding assembly according to claim 3, wherein the first bent conduction sheet comprises a first main body and a first through hole, and the first through hole is formed in the first main body.

5. The conductive winding assembly according to claim 4, wherein the second bent conduction sheet comprises a second main body and a second through hole, and the second through hole is formed in the second main body, wherein after the first bent conduction sheet and the second bent conduction sheet are combined together, the first main body is accommodated within the second through hole, and the first through hole and the second through hole are collaboratively defined as the channel.

6. The conductive winding assembly according to claim 5, wherein the first bent conduction sheet further comprises a first extension part and a second extension part, which are extended from the first main body, wherein the second bent conduction sheet further comprises a third extension part and a fourth extension part, which are extended from the second main body.

7. The conductive winding assembly according to claim 6, wherein the third extension part is aligned with the second extension part, wherein when the first bent conduction sheet and the second bent conduction sheet are combined together, the second extension part are stacked on the third extension part.

8. The conductive winding assembly according to claim 7, wherein the second extension part comprises a first engaging part, and the third extension part comprises a second engaging part corresponding to the first engaging part, wherein when the first bent conduction sheet and the second bent conduction sheet are combined together and the second extension part are stacked on the third extension part, the first engaging part and the second engaging part are engaged with each other, so that the first bent conduction sheet and the second bent conduction sheet are securely connected with each other.

9. The conductive winding assembly according to claim 6, wherein the first extension part and the second extension part are extended outwardly from two edges of the first main body, and the first extension part and the second extension part are in parallel with each other, wherein the third extension part and the fourth extension part are extended outwardly from two edges of the second main body, and the third extension part and the fourth extension part are in parallel with each other.

10. The conductive winding assembly according to claim 6, wherein the first extension part and the second extension part are extended outwardly from two edges of the first main body, and the first extension part and the second extension part are perpendicular to each other, wherein the third extension part and the fourth extension part are extended outwardly from two edges of the second main body, and the third extension part and the fourth extension part are perpendicular to each other.

11. The conductive winding assembly according to claim 1, wherein after the bent conduction sheet member is partially accommodated within the hollow part, a top side of the bent conduction sheet member, a top portion of the first lateral plate and a top portion of the second lateral plate are on a common plane.

12. The conductive winding assembly according to claim 1, wherein when the bent conduction sheet member is partially accommodated within the hollow part, the bent conduction sheet member is in contact with the first lateral plate and the second lateral plate.

13. The conductive winding assembly according to claim 12, wherein the first lateral plate further comprises a first heat-dissipating recess, and the second lateral plate further comprises a second heat-dissipating recess, wherein the first heat-dissipating recess is concaved in a top surface of the first lateral plate, and the second heat-dissipating recess is concaved in a top surface of the second lateral plate, wherein when the bent conduction sheet member is accommodated within the hollow part, bilateral sides of the bent conduction sheet member are partially exposed outside the covering member through the first heat-dissipating recess and the second heat-dissipating recess.

14. The conductive winding assembly according to claim 1, wherein the covering member further comprises a position-limiting plate, and the position-limiting plate is arranged between the first lateral plate and the second lateral plate, wherein the position-limiting plate is connected with a first end of the first lateral plate, a first end of the second lateral plate and a first end of the connection part, wherein after the bent conduction sheet member is accommodated within the covering member through the first groove and the second groove, the conduction sheet member is stopped by the position-limiting plate.

15. The conductive winding assembly according to claim 14, wherein the covering member further comprises a plurality of bulges, wherein the bulges are disposed on a top surface of the connection part and arranged beside the position-limiting plate, wherein when the bent conduction sheet member is accommodated within the covering member and the connection part is inserted into the channel, the bulges are sustained against an inner wall of the bent conduction sheet member, so that the bent conduction sheet member is inclined inserted into the covering member.

16. The conductive winding assembly according to claim 15, wherein the covering member further comprises a coupling plate, wherein the coupling plate is located at the top side of the covering member, arranged between the first lateral plate and the second lateral plate and opposed to the position-limiting plate, wherein the coupling plate is connected with a second end of the first lateral plate and a second end of the second lateral plate, wherein when the bent conduction sheet member is partially accommodated within the hollow part of the covering member, the coupling plate is in contact with the bent conduction sheet member, so that the bent conduction sheet member is fixed in the covering member through the first lateral plate, the second lateral plate, the position-limiting plate and the coupling plate.

17. The assembled structure according to claim 1, wherein the conductive winding assembly comprises a plurality of third engaging parts, and the magnetic device comprises a bobbin comprising a plurality of fourth engaging parts corresponding to the third engaging parts, wherein when the third engaging parts and the fourth engaging parts are engaged with each other, the conductive winding assembly and the bobbin are combined together.

18. The conductive winding assembly according to claim 1, wherein the covering member is made of an insulating material.

19. A covering member for a magnetic device, wherein the covering member is connectable with a bent conduction sheet member of the magnetic device and the covering member is used for partially covering an outer periphery of the bent conduction sheet member, wherein a channel of the bent conduction sheet member is formed by four sides, and the four sides surround the channel, the covering member comprising:

a connection part;

a first lateral plate located at a first side of the connection part, wherein a first groove is arranged between the first lateral plate and the connection part;

a second lateral plate located at a second side of the connection part, and opposed to the first lateral plate, wherein a second groove is arranged between the second lateral plate and the connection part, wherein the bent conduction sheet member is inserted into the covering member through the first groove and the second groove, and the connection part is inserted into the channel; and a hollow part defined by the first lateral plate, the second lateral plate and a top surface of the connection part and located at a top side of the covering member, wherein the bent conduction sheet member is partially accommodated within the hollow part, and the bent conduction sheet member is partially exposed outside the covering member through the hollow part.

* * * * *